US007583248B2

(12) United States Patent
Bou-Chi et al.

(10) Patent No.: US 7,583,248 B2
(45) **Date of Patent: *Sep. 1, 2009**

(54) METHOD FOR MODULATING AND DRIVING BACKLIGHT SOURCES FOR FLAT PANEL DISPLAYS

(75) Inventors: Chang Bou-Chi, Hsinchu (TW); Liou Chang-Ho, Changhua County (TW); Chang Yu-Xian, Shulin (TW); Chung Chun-Fu, Pingtung County (TW)

(73) Assignee: Industrial Technology Research Institute, HsinChu (TW)

( * ) Notice: Subject to any disclaimer, the term of this patent is extended or adjusted under 35 U.S.C. 154(b) by 567 days.

This patent is subject to a terminal disclaimer.

(21) Appl. No.: 11/205,089

(22) Filed: Aug. 17, 2005

(65) Prior Publication Data

US 2006/0055659 A1 Mar. 16, 2006

(30) Foreign Application Priority Data

Sep. 10, 2004 (TW) ..... 93127379 A

(51) Int. Cl.
*G09G 3/36* (2006.01)

(52) U.S. Cl. ..... 345/102

(58) Field of Classification Search ..... 345/82, 345/102, 211; 349/61, 68–70; 362/211
See application file for complete search history.

(56) References Cited

U.S. PATENT DOCUMENTS 5,121,233 A * 6/1992 Spencer et al. ..... 349/69
7,215,317 B2 * 5/2007 Liou et al. ..... 345/102
7,256,763 B2 * 8/2007 Kaneki et al. ..... 345/102
7,304,633 B2 * 12/2007 Kim et al. ..... 345/102
2002/0008694 A1 * 1/2002 Miyachi et al. ..... 345/204
2002/0057241 A1 * 5/2002 Oda et al. ..... 345/87
2003/0043097 A1 * 3/2003 Shingai et al. ..... 345/87
2005/0007516 A1 * 1/2005 Hong et al. ..... 349/64
2007/0024570 A1 * 2/2007 Kumamoto ..... 345/102

* cited by examiner

*Primary Examiner*—Sumati Lefkowitz
*Assistant Examiner*—Rodney Amadiz
(74) *Attorney, Agent, or Firm*—WPAT, P.C.; Justin I. King

(57) ABSTRACT

The present invention provides a method for modulating backlight sources for flat panel displays (FPD), which comprises: lowing steps: step 31: turning on a display screen; step 32: identifying whether the total number of the BLS groups provided on the backlight module is an odd number or an even number; step 33: turning on the one BLS group located at the center-most region of the backlight module while the total number of the BLS groups is an odd number; step 34: turning on one of the two BLS groups located at the center-most region of the screen while the total number of the BLS groups is an even number; step 35: turning on another one of the two center-most BLS groups while turning off the previous turned-on center-most BLS group, and then turning on a BLS group located at the outer side of the turned-off center-most BLS group while turning off another turned-on center-most BLS group, and similarly, by iteratively progressing the turning-on and the turning-off from the center region to the two outer edge of the backlight module so as to complete a full cycle; step 36: determining whether the display screen is off, if so, the process proceeds to step (37); otherwise, the process goes to step (31); and step 37: ending the process.

6 Claims, 8 Drawing Sheets

METHOD FOR MODULATING AND DRIVING BACKLIGHT SOURCES FOR FLAT PANEL DISPLAYS

FIELD OF THE INVENTION

The present invention relates to a method for modulating and driving the backlight sources used in a flat panel display, and more particularly, to a method of reducing display non-uniformity by changing the turn on sequence of the backlight module.

BACKGROUND OF THE INVENTION

The appearance and subsequent development of electronic products started only a few decades ago; however, the progressing speed of this industry has surpassed many others. This is especially so in the development of computer related periphery products and video-audio products. New products are ever emerging due to the needs of the working people and recreation needs of the general population. Much progress has been made in these areas; new products are ever emerging. Take the display product for instance; the conventionally used display is constituted of a Cathode Ray Tube (CRT), which usually has the following drawbacks:

1. Since the conventional display is not equipped with flat screen, it is often suffering from a phenomenon of image twisting during watching.
2. The conventional cathode ray tube has comparatively larger power consumption, that is, the cathode ray tube will consume a conceivable more electricity that, as the consequence, the display of cathode ray tube suffers from the phenomena of high temperature and heat.
3. The size reduction of a display system cannot be achieved due to the bulky conventional CRT, causing great inconvenience for utilization of a limited space.

Because of the drawbacks associated with a conventional CRT as indicated above, many display manufacturers have devoted all their efforts to developing displays of the next generation, which include Liquid Crystal Display (LCD), Plasma Panel Display (PPD) and etc. As it stands now, the manufacturing technology of CRT is getting matured; as a result, the cost of a CRT has been reduced to that comparable to a conventional CRT. In addition, the low radio-emission, low power consumption, reduced size and wide view-angle and many other virtues associated with a LCD have made LCD become the favorite display system of the general users.

At present, LCD displays are mostly used in computer monitors, liquid crystal TV sets, and the display systems of 3C electronic products (for example, mobile phones and digital cameras), and the like. It covers a wide variety of applications. Since the liquid crystal is non-luminescent on its own, no direct viewing is possible by human naked eyes. As such, the backlight module has to be included as part of the LCD panel. By virtue of this, clear pictures are made possible if the LCD is provided with a sufficient brightness. However, for the sake of saving the power consumed by a LCD, the backlight sources provided on a backlight module are not supposed to be turned on concurrently. The backlight sources provided on a backlight module associated with a LCD have to be powered-on sequentially, according to the positions of the liquid crystal pixel involved, starting from top to bottom or from bottom to top in the display screen. By doing so, the aims of displaying clear picture and saving of power consumption can thus be achieved. However, the conventional means for lighting up the backlight sources provided on the backlight module of a display system would create a non-uniform brightness on the display screen, that is, the conventional method for lighting up the backlight module would cause non-uniform brightness of the display screen. This problem is due to the time lag existing between power-on of the backlight sources located in the upper potion of the display and power-off of backlight sources located in the lower portion of the display. The duration of time lag, though as short as it may be, can induce enough brightness non-uniformity perceptible to the viewers. As such, doubts about the quality of the display are generated among the consumers at large. The present invention is aimed to solve the problem mentioned above.

SUMMARY OF THE INVENTION

The present invention is motivated by the object to eliminate the drawback of non-uniform brightness associated with the LCD display screen manufactured by the prior art. It is the primary object of the invention to provide a method of reducing display nonuniformity by changing the turn on sequence of the backlight module of a flat panel display, that is, alternately turning on and off the power of the backlight sources provided on a backlight module.

In order to accomplish the object mentioned above, the first embodiment of the present invention provides a method for modulating the backlight source provided on a backlight module, involving alternately turning on and off the backlight sources provided on a backlight module. The method comprises the steps of:

(a1) turning on a display screen;

(a2) identifying whether the total number of the backlight sources provided on the backlight module is an odd number or an even number;

(a3) turning on the one backlight source located at the center-most region of the backlight module while the total number of the backlight sources is an odd number;

(a4) turning on one of the two backlight sources located at the center-most region of the screen while the total number of the backlight sources is an even number;

(a5) turning on another one of the two center-most backlight sources while turning off the previous turned-on center-most backlight source, and then turning on a backlight source located at the outer side of the turned-off center-most backlight source while turning off another turned-on center-most backlight source, and similarly, by iteratively progressing the turning-on and the turning-off from the center region to the two outer edge of the backlight module so as to complete a full cycle;

(a6) determining whether the display screen is off; if so, the process proceeds to step (a7); otherwise, the process goes to step (a1); and (a7) ending the process.

In order to achieve the object mentioned above, the second embodiment of the present invention provides a method for modulating the backlight source provided on a backlight module, involving alternately turning on and off the backlight sources provided on a backlight module. The method comprises the steps of:

(a1') turning on a display screen;

(a2') identifying whether the total number of the backlight sources provided on the backlight module is an odd number or an even number;

(a3') turning on one of the two backlight sources respectively located at the two outermost region of the backlight module and then turning on the another one of the two outermost backlight sources while turn off the previous turned-on outermost backlight source, and similarly, by iteratively progressing the turning-on and the turning-off respectively from the two edges toward the center region of the backlight module, so as to complete a full cycle;

(a4') turning on the one backlight source located at the center-most region of the backlight module while the total number of backlight sources is an odd number;

(a5') turning on one of the two backlight sources located at the center-most region of the backlight module while the total number of backlight sources is an even number;

(a6') determining whether the display screen is off; if so, the process proceeds to step (a7'); otherwise, the process goes to step (a1'); and (a7') ending the process.

Summarizing the above, the structure characteristics and the embodiments of the present invention have been disclosed in detail. The present invention has fully demonstrates its novelty and industrial utility. Furthermore, to the best of our knowledge, its usage has never been applied in any products.

DESCRIPTION OF THE PREFERRED EMBODIMENT

The preferred embodiments disclosed according to the invention are elaborated in conjunction with the drawings attached herein. The technical means disclosed in the present invention is principally applied in a liquid crystal display (LCD) and an organic light emitting diode (OLED). The drawings attached hereafter are used for illustration purpose, with the aim to facilitate understanding the technical detail involved. Hence, they are by no means used for excluding any other possible embodiments of the present invention. Lamps are used as the example for the backlight source in the following preferred embodiments of the invention.

Figure 1:
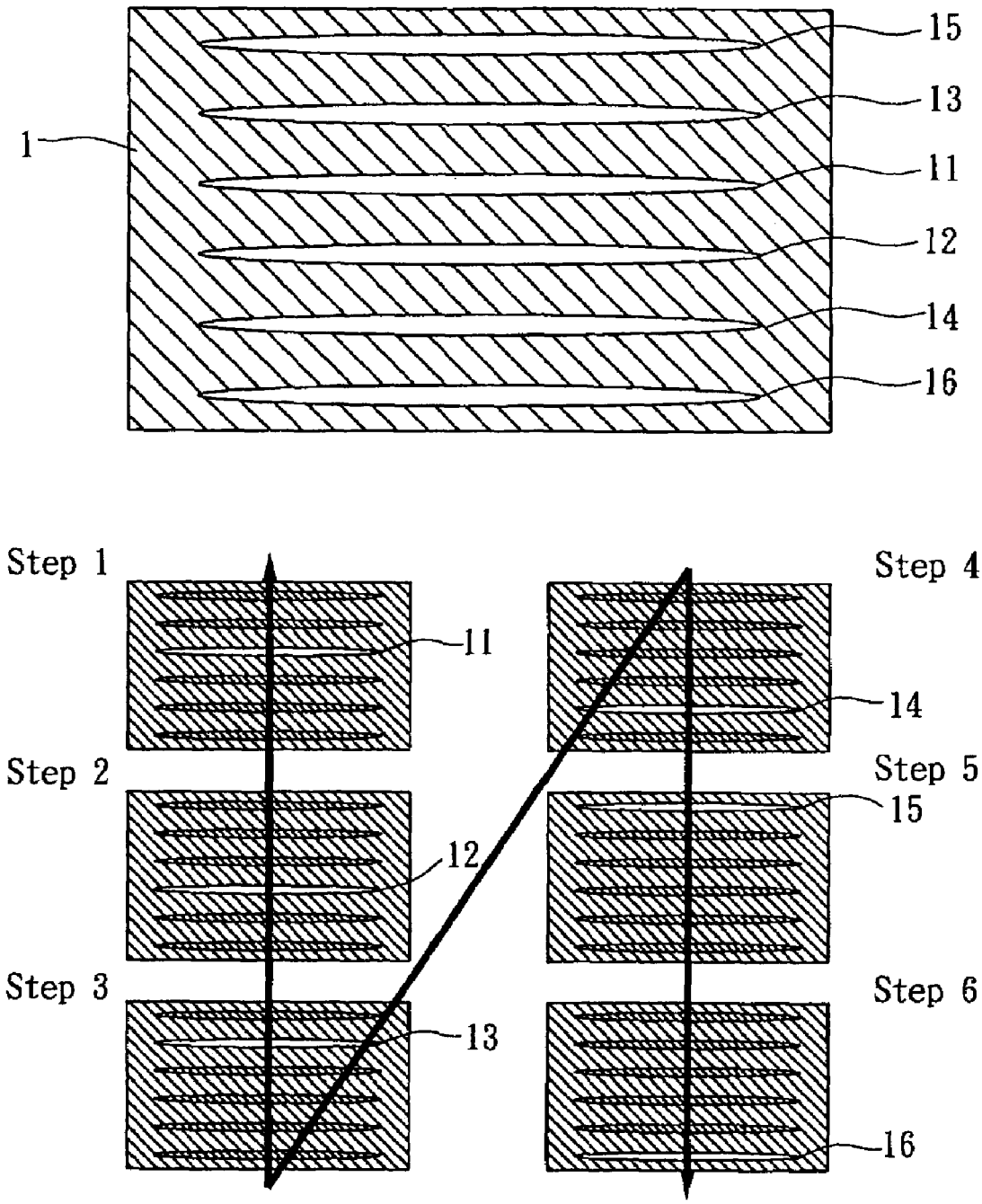
FIG. 1 is the schematic representation showing a turn on sequence of a backlight module according to the first preferred embodiment of the present invention.

FIG. 1 illustrates the sequence for lighting up the lamps of the backlight module, as disclosed in the first preferred embodiment of the present invention, wherein there are an even number of backlight lamp (BLL) groups provided on the display 1. (There are 6 groups of BLL in this embodiment of the present invention.) The two BLL groups located at the central area of the display are respectively the first set of BLL 11 and the second set of BLL 12, where the third set of BLL 13, the fourth set of BLL 14, the fifth set of BLL 15 and the sixth set of BLL 16 are iteratively arranged and progressing outward therefrom. TThe sequence for lighting up the BLL provided on the Backlight Module is described as follows:

Step 1: turning on the BLL groups of the BLL set 11;

Step 2: turning on the BLL groups of the second BLL set 12 while turning off the BLL groups of the first BLL set 11;

Step 3: turning on the BLL groups of the third BLL set 13 while turning off the BLL groups of the second BLL set 12;

Step 4: turning on the BLL groups of the fourth BLL set 14 while turning off the BLL groups of the third BLL set 13;

Step 5: turning on the BLL groups of the fifth BLL set 15 while turning off the BLL groups of fourth BLL set 14; and Step 6: turning on the BLL groups of the sixth BLL set 16 while turning off the BLL groups of the fifth BLL set 15.

Moreover, it is intended to repeat the cycle from Step 1 to Step 6, if the image on the display 1 is not completely shut down.

Figure 2:
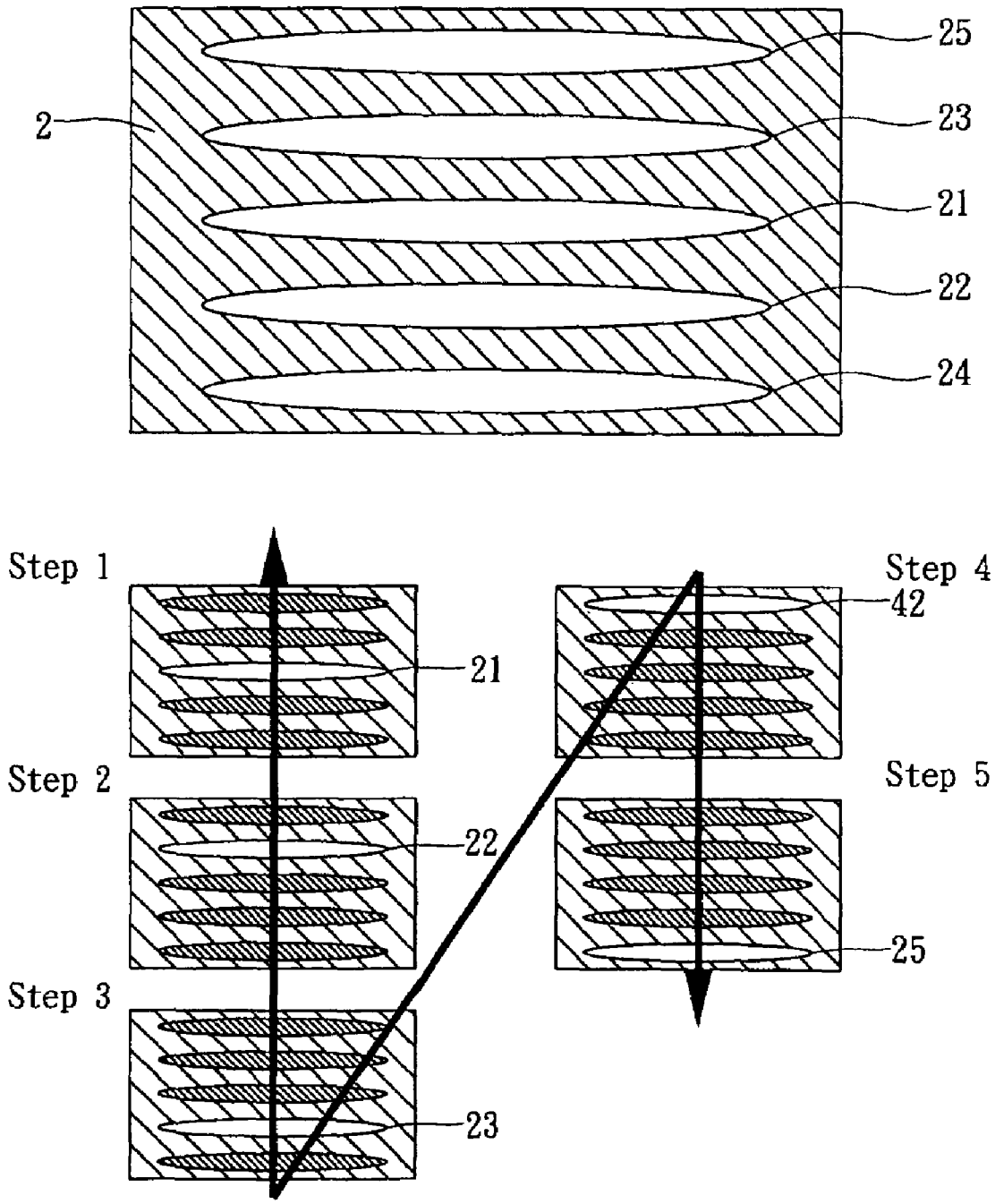
FIG. 2 is the schematic representation showing a turn on sequence of a backlight module according to the second preferred embodiment of the present invention
Figure 3:
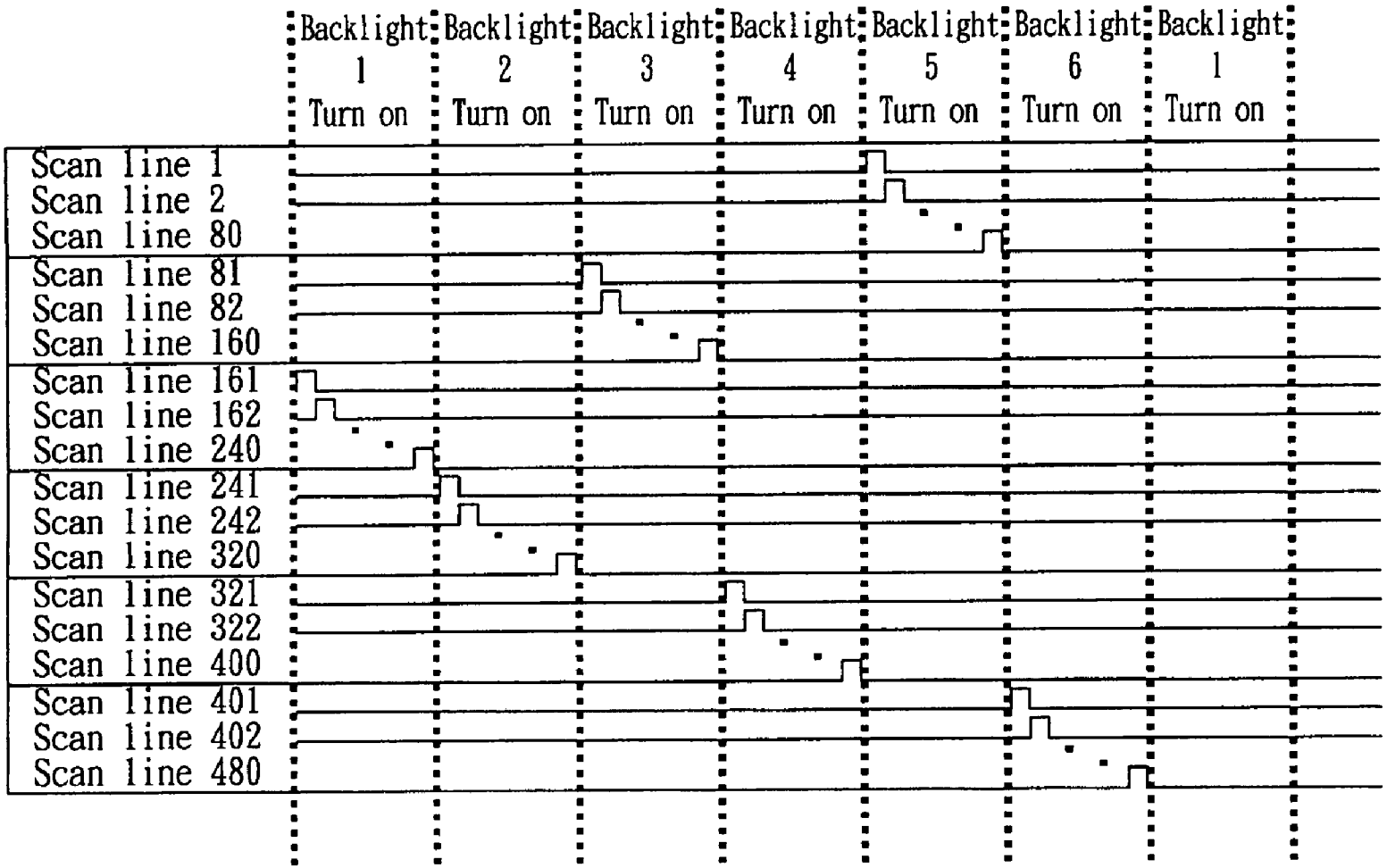
FIG. 3 is the schematic representation showing the scanning lines and the time control scheme according to the present invention.

FIG. 2 illustrates the sequence for lighting up the backlight lamps (BLL) of the backlight module, as disclosed in the second preferred embodiment of the present invention, wherein there are an odd number of the BLL sets provided on the display 2. (There are 5 sets of BLL groups in this embodiment of the present invention.) The BLL group located at the central area of the display is the first BLL set 21, from which iteratively progressing outward are the second BLL set 22, the third BLL set 23, the fourth BLL set 24, and the fifth BLL set 25. The sequence for lighting up the BLL groups is described in the following steps:

Step 1: turning on the first BLL set 21;

Step 2: turning on the second BLL set 22 while turning off the first BLL set 21;

Step 3: turning on the third BLL set 23 while turning off the second BLL set 22;

Step 4: turning on the fourth BLL set 24 while turning off the third BLL set 23;

Step 5: turning on the fifth BLL set 25 while turning off the fourth BLL set 24;

Moreover, it is intended to repeat the cycle from Step 1 to Step 5, if the image on the display 2 is not completely shut down.

Summarizing what has been disclosed above, the sequence for lighting up the backlight lamps (BLL) provided on a backlight module starts from the central region of the display and progresses toward the outer region, either lighting up or extinguishing the lamps of the backlight module involved, regardless the total number of BLL groups is odd or even. For those who are familiar with the subject technology, the sequence for lighting up or extinguishing the BLL sets of the BLL groups in the display can also be performed starting from the lamp located at the outer region of the display and completed at the central region of the display.

Figure 5:
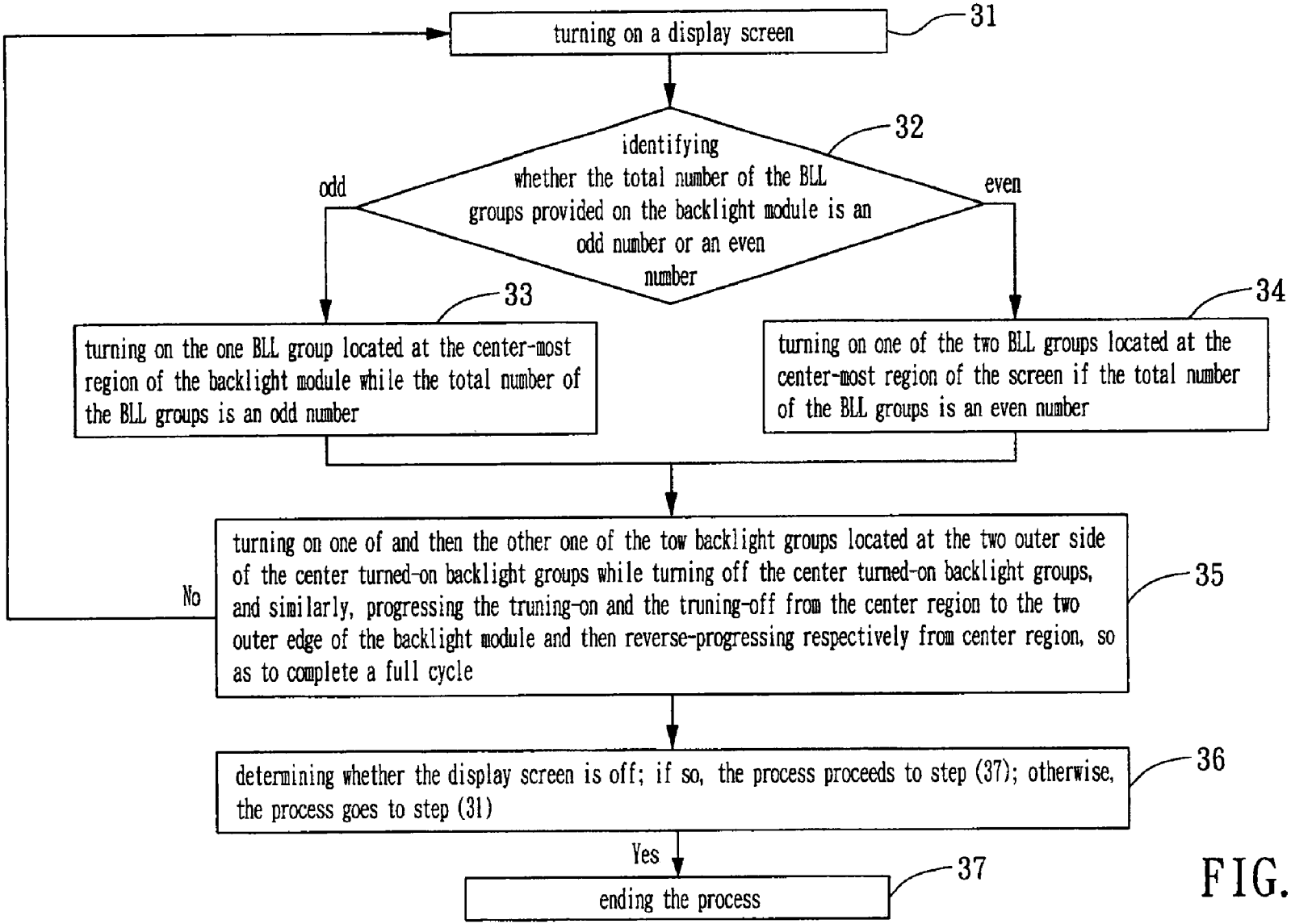
FIG. 5 is a flow depicting the first embodiment of the present invention.

According to what has been disclosed in FIGS. 1 and 2, the flow chart for execution is formulated. Please refer to FIG. 5, which is the first embodiment of the invention that includes series of sequential steps for modulating the power on/off state of the BLL (Backlight Lamps) provided on a display system. FIG. 5 includes the following steps:

Step 31: turning on a display screen;

Step 32: identifying whether the total number of the BLL groups provided on the backlight module is an odd number or an even number;

Step 33: turning on the one BLL group located at the center-most region of the backlight module if the total number of the BLL groups is an odd number;

Step 34: turning on one of the two BLL groups located at the center-most region of the screen if the total number of the BLL groups is an even number;

Step 35: turning on one of and then the other one of the two backlight groups located at the two outer side of the center turned-on backlight groups while turning off the center turned-on backlight groups, and similarly, progressing the turning-on and the turning-off from the center region to the two outer edge of the backlight module and then reverse-progressing respectively from the two edges to the center region, so as to complete a full cycle;

Step 36: determining whether the display screen is off; if so, the process proceeds to step (37); otherwise, the process goes to step (31); and;

Step 37: ending the process.

Figure 4B:
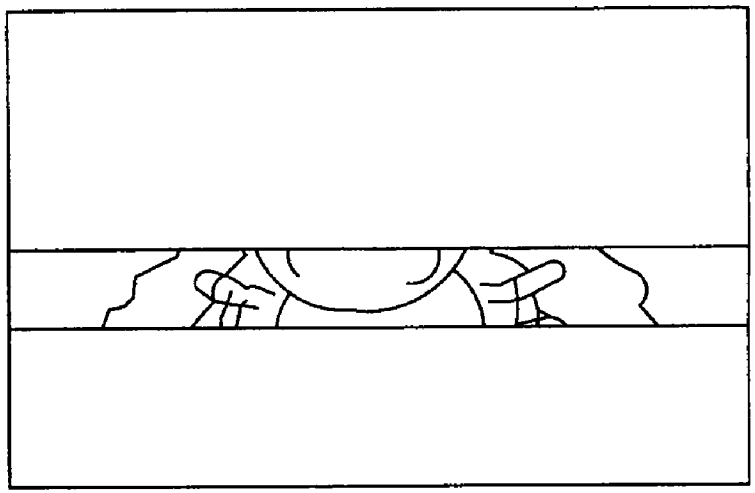
FIG. 4B is the schematic representation showing the display screen after the second backlight source is power-on according to the present invention.
Figure 4A:
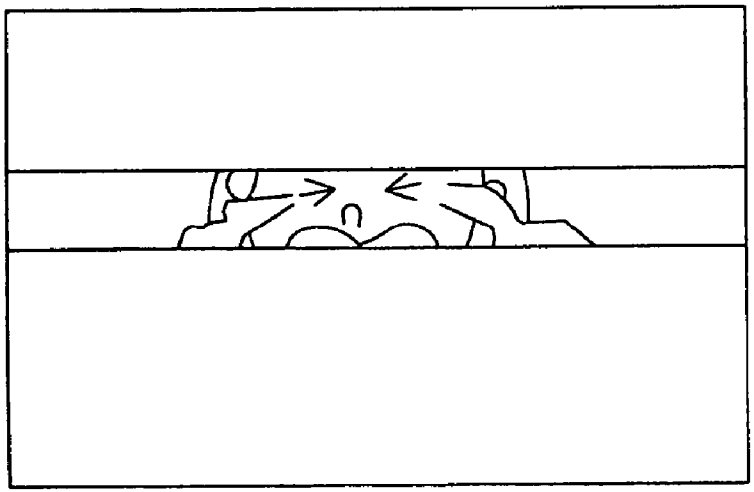
FIG. 4A is the schematic representation showing the display screen after the first backlight source is power-on according to the present invention.

Please refer to FIG. 4A, which is the schematic representation of a display that is displaying an image in the central area of the screen at this moment. This area corresponds to the location where the first set of BLL is located. Notice that this is the moment when only the first set of BLL units is been lighted up; whereas, the second, the third, the fourth, the fifth and the sixth sets of BLL units, which are located in other areas is the display are all been extinguished at the moment.

Please refer to FIG. 4B, which is the schematic representation of a display that is displaying images in the outer areas of the screen at this moment corresponding to the second set of Backlight modules is located. Notice that this is the moment when only the second set of BLL units is been lighted up; whereas, the first, the third, the fourth, the fifth and the sixth sets of BLL units, which are located in other areas is the display are all been extinguished at the moment.

Figure 4D:
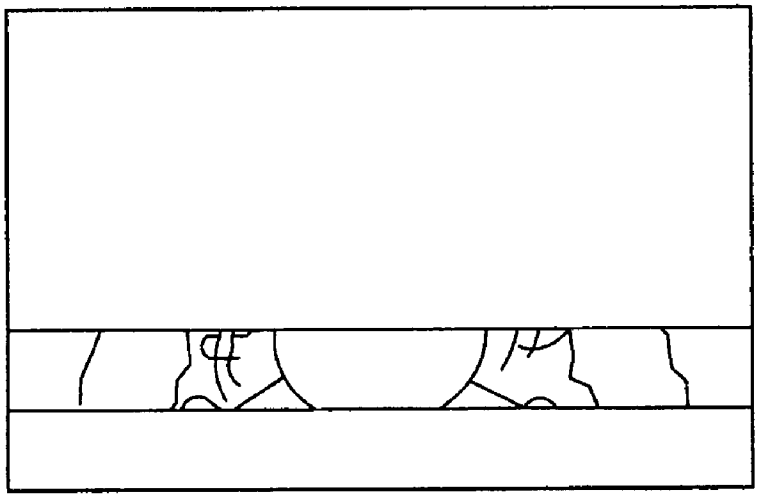
FIG. 4D is the schematic representation showing the display screen after the fourth backlight source is power-on according to the present invention.
Figure 4C:
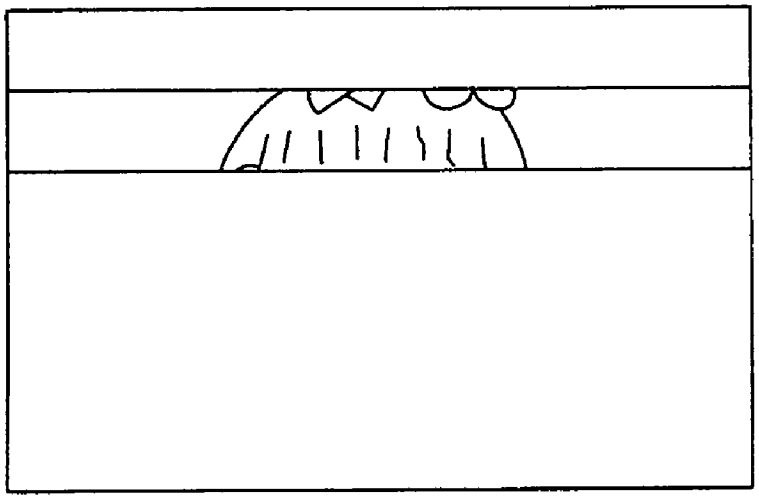
FIG. 4C is the schematic representation showing the display screen after the third backlight source is power-on according to the present invention.

Please refer to FIG. 4C, which is the schematic representation of a display that is displaying images in the outer areas of the screen at this moment corresponding to the third set of Backlight modules is located. Notice that this is the moment when only the second set of BLL units is been lighted up; whereas, the first, the second, the fourth, the fifth and the sixth sets of BLL units, which are located in other areas is the display are all been extinguished at the moment.

Please refer to FIG. 4D, which is the schematic representation of a display that is displaying images in the outer areas of the screen at this moment corresponding to the fourth set of Backlight modules is located. Notice that this is the moment when only the second set of BLL units is been lighted up; whereas, the first, the second, the third, the fifth and the sixth sets of BLL units, which are located in other areas is the display are all been extinguished at the moment.

Figure 4F:
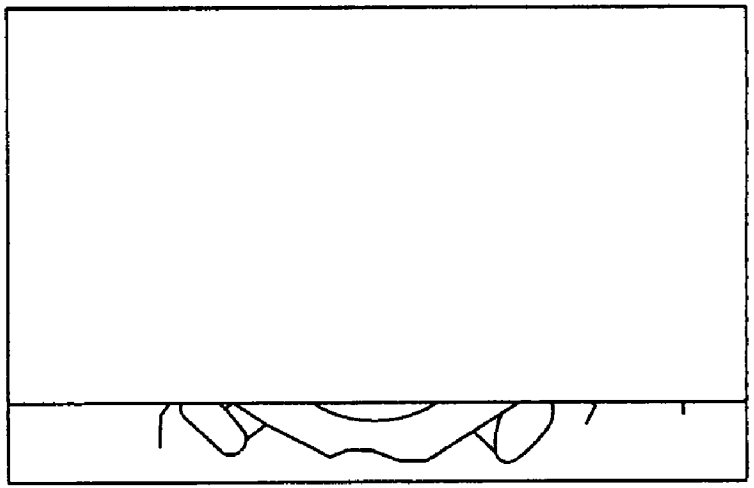
FIG. 4F is the schematic representation showing the display screen after the sixth backlight source is power-on according to the present invention.
Figure 4E:
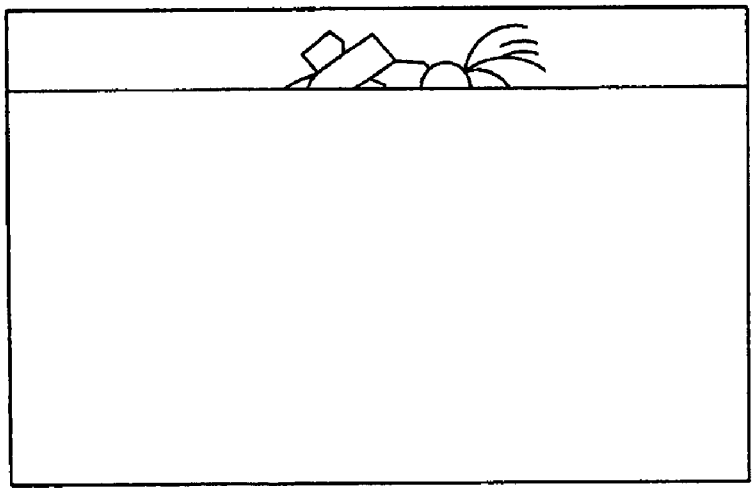
FIG. 4E is the schematic representation showing the display screen after the fifth backlight source is power-on according to the present invention.

Please refer to FIG. 4E, which is the schematic representation of a display that is displaying images in the outer areas of the screen at this moment corresponding to the fifth set of Backlight modules is located. Notice that this is the moment when only the second set of BLL units is been lighted up; whereas, the first, the second, the third, the fourth and the sixth sets of BLL units, which are located in other areas is the display are all been extinguished at the moment.

Please refer to FIG. 4F, which is the schematic representation of a display that is displaying images in the outer areas of the screen at this moment corresponding to the sixth set of Backlight modules is located. Notice that this is the moment when only the second set of BLL units is been lighted up; whereas, the first, the second, the third, the fourth and the fifth sets of BLL units, which are located in other areas is the display are all been extinguished at the moment.

According to what has been disclosed in FIGS. 1 and 2, the flow chart for execution is formulated. Please refer to FIG. 5, which is the first embodiment of the invention that includes series of sequential steps for modulating the power on/off state of the BLL (Backlight Lamps) provided on a display system. FIG. 5 includes the following steps:

Step 31: turning on a display screen;

Step 32: identifying whether the total number of the BLL groups provided on the backlight module is an odd number or an even number;

Step 33: turning on the one BLL group located at the center-most region of the backlight module while the total number of the BLL groups is an odd number;

Step 34: turning on the two BLL groups located at the center-most region of the screen while the total number of the BLL groups is an even number;

Step 35: turning on the two backlight groups located at the two outer side of the center turned-on backlight groups while turning off the center turned-on backlight groups, and similarly, progressing the turning-on and the turning-off from the center region to the two outer edge of the backlight module and then reverse-progressing respectively from the two edges to the center region, so as to complete a full cycle;

Step 36: determining whether the display screen is off; if so, the process proceeds to step (37); otherwise, the process goes to step (31); and;

Step 37: ending the process.

Figure 6:
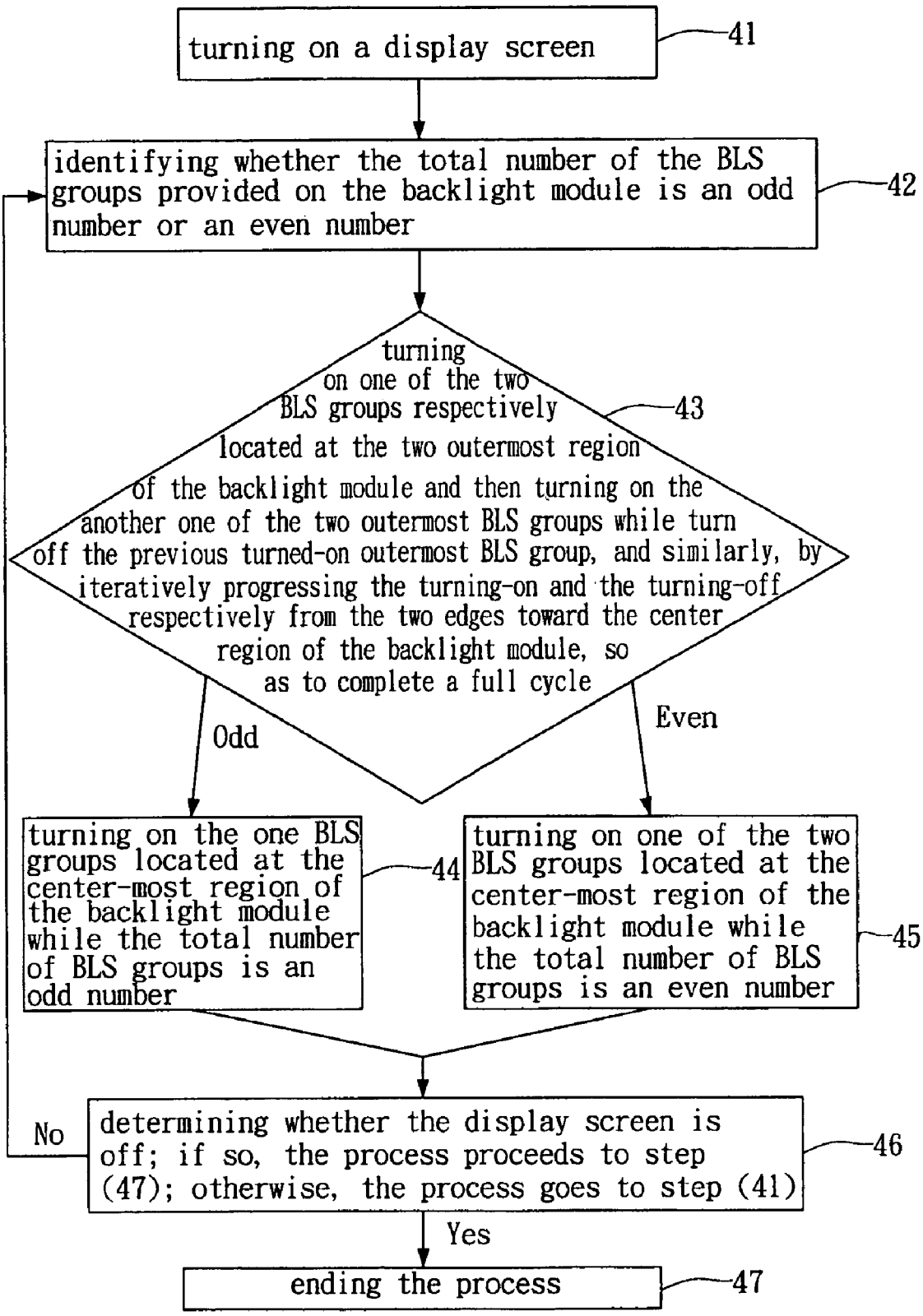
FIG. 6 is the flow depicting the second embodiment of the present invention.

Please refer to FIG. 6, which is the second embodiment of the invention that includes series of sequential execution steps for modulating the power on/off state of the BLL (Backlight Lamps) provided on a display system. FIG. 6 includes the following steps:

Step 41: turning on a display screen;

Step 42: identifying whether the total number of the BLL groups provided on the backlight module is an odd number or an even number;

Step 43: turning on the two BLL groups respectively located at the two outermost region of the backlight module and then turning on the two BLL groups respectively located adjacent to the two outermost turned-on BLL groups while turning off the two outermost turned-on BLL groups, and similarly, progressing the turning-on and the turning-off respectively from the two edges toward the center region of the backlight module, and then reverse-progressing from the center region toward the two edges, so as to complete a full cycle;

Step 44: turning on the one BLL groups located at the center-most region of the backlight module while the total number of BLL groups is an odd number;

Step 45: turning on the two BLL groups located at the center-most region of the backlight module while the total number of BLL groups is an even number;

Step 46: determining whether the display screen is off; if so, the process proceeds to step (47); otherwise, the process goes to step (41); and Step 47: ending the process.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A method for modulating and driving backlight source (BLS) groups of a flat panel display, comprising series of execution steps in the sequence set forth:

(a1) turning on a display screen;

(a2) identifying the total number of the BLS groups provided on the backlight module;

(a3) turning on the BLS group located at the center-most region of the backlight module if the total number of the BLS groups is an odd number;

(a4) turning on one of the two BLS groups located at the center-most region of the screen if the total number of the BLS groups is an even number;

(a5) turning on a BLS group adjacent to one side of the turned-on center-most BLS group while turning off the turned-on center-most BLS group, then turning on a BLS group adjacent to another side of the turned-off center-most BLS group while turning off the previous turned-on BLS group, and similarly, by iteratively progressing the turning-on and the turning-off from the center region to the two outer edge of the backlight module so as to complete a full cycle;

(a6) determining whether the display screen is off; if so, the process proceeds to step (a7); otherwise, the process goes to step (a1); and (a7) ending the method.

2. The method as recited in claim 1, wherein the flat panel display is a light emitting diode (LED).

3. The method as recited in claim 1, wherein the flat panel display is an organic light emitting diode (OLED).

4. A method for modulating and driving backlight source (BLS) groups of a flat panel display, comprising series of execution steps in the sequence set forth:

(a1') turning on a display screen;

(a2') identifying the total number of the BLS groups provided on the backlight module;

(a3') turning on one of the two BLS groups respectively located at the two outermost region of the backlight module and then turning on the another one of the two outermost BLS groups while turn off the previous turned-on outermost BLS group, and similarly, by iteratively progressing the turning-on and the turning-off respectively from the two edges toward the center region of the backlight module, so as to complete a full cycle;

(a4') turning on the one BLS group located at the center-most region of the backlight module if the total number of BLS group is an odd number;

(a5') turning on one of the two BLS groups located at the center-most region of the backlight module if the total number of BLS group is an even number;

(a6') determining whether the display screen is off; if so, performing step (a7'); otherwise, going back to step (a1'); and (a7') ending the method.

5. The method as recited in claim 4, wherein the flat panel display is a liquid panel display (LCD).

6. The method as recited in claim 4, wherein the flat panel display is an organic light emitting diode (OLED).

* * * * *